US011773651B2

(12) United States Patent
Pesaresi

(10) Patent No.: US 11,773,651 B2
(45) Date of Patent: Oct. 3, 2023

(54) DRILLING MACHINE FOR FOUNDATION PILES COMPRISING AN ELECTRIC ENERGY RECOVERY WINCH

(71) Applicant: GEAX SRL, Montefano (IT)

(72) Inventor: Adriano Pesaresi, Osimo (IT)

( * ) Notice: Subject to any disclaimer, the term of this patent is extended or adjusted under 35 U.S.C. 154(b) by 1063 days.

(21) Appl. No.: 16/561,636

(22) Filed: Sep. 5, 2019

(65) Prior Publication Data

US 2020/0109037 A1 Apr. 9, 2020

(30) Foreign Application Priority Data

Oct. 5, 2018 (IT) ..... 102018000009205

(51) Int. Cl.

| | |
|---|---|
| ***E21B 7/02*** | (2006.01) |
| ***E02D 7/16*** | (2006.01) |
| ***E21B 15/00*** | (2006.01) |
| *B66D 1/12* | (2006.01) |
| *B66D 1/08* | (2006.01) |

(52) U.S. Cl.

CPC ..... *E21B 7/021* (2013.01); *E02D 7/16* (2013.01); *E21B 15/003* (2013.01); *B66D 1/08* (2013.01); *B66D 1/12* (2013.01); *B66D 2700/0133* (2013.01)

(58) Field of Classification Search

CPC ..... E21B 7/021; E21B 15/003; E02D 7/16; B66D 1/08; B66D 1/12; B66D 2700/0133

See application file for complete search history.

(56) References Cited

U.S. PATENT DOCUMENTS

| | | | | |
|---|---|---|---|---|
| 2,869,826 | A * | 1/1959 | Thornburg | E21B 19/146 173/147 |
| 9,574,403 | B2 * | 2/2017 | Ferrari | E21B 15/00 |
| 2017/0066634 | A1 * | 3/2017 | Kawai | B66D 5/02 |
| 2019/0077641 | A1 * | 3/2019 | Stensland | B66D 1/08 |

FOREIGN PATENT DOCUMENTS

| | | | |
|---|---|---|---|
| DE | 3721526 | A1 | 1/1989 |
| EP | 2514706 | A1 | 10/2012 |

OTHER PUBLICATIONS

Search Report Form IT237 "Written Opinion" dated Apr. 3, 2019, with reference to the Italian Patent Application No. IT 102018000009205.

* cited by examiner

*Primary Examiner* — D. Andrews

(74) *Attorney, Agent, or Firm* — Egbert, McDaniel & Swartz, PLLC

(57) ABSTRACT

A self-propelling drilling machine includes: an undercarriage. a rotary tower, a mast, a kelly bar supported by the mast, a drilling tool fixed at one end of the kelly bar, and a winch associated with the kelly bar to move the kelly bar upwards or downwards. An electric rotary machine is configured to operate as an electric motor suitable for rotating the winch and as an electric generator during the lowering of the kelly bar that causes a rotation of the winch. The machine includes a power supply unit operatively connected to the electric rotary machine.

3 Claims, 3 Drawing Sheets

DRILLING MACHINE FOR FOUNDATION PILES COMPRISING AN ELECTRIC ENERGY RECOVERY WINCH

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to the field of self-propelling drilling machine used to drill holes in the ground for foundation piles.

2. Description of Related Art Including Information Disclosed Under 37 CFR 1.97 And 37 CFR 1.98

Drilling machines are known in the prior art in order to drill holes in the ground for installing piles, such as foundation piles for buildings and/or infrastructures, or for forming piles directly in the hole drilled by the machine.

Said drilling machines comprise an undercarriage, typically with tracks, and a rotary tower provided with a boom, which is associated with a mast disposed in vertical direction during use.

A kelly bar, typically a telescopic one, is slidingly associated to the mast. A rotary is coupled with the mast and receives the kelly bar in such a way to let the kelly bar slide along a development direction of the mast. The rotary comprises actuators that can be activated to engage and rotate the kelly bar around a longitudinal axis. Moreover, a winch is associated with the kelly bar in such a way to lift the kelly bar along the direction of the hole drilled into the ground when the kelly bar is disengaged from the rotary.

At least one between the mast and the rotary can be translated, moving closer to or farther from the ground to be drilled, by means of a thrust unit.

Typically, an internal combustion engine of the machine is connected to the pump of a hydraulic actuation system comprising pistons, motors and pumps, which are connected to the thrust unit, to the rotary and to the winch in order to actuate them.

When used, the telescopic kelly bar is disposed where the hole is to be drilled into the ground; the kelly bar is lowered because of its weight, disengaging the winch; then, the rotary engages the kelly bar in order to rotate it and the thrust unit moves the mast, or the rotary, towards the ground in such a way that the tool fixed to the kelly bar can drill the ground until a first depth is reached. Then, the mast, or the rotary, is moved away from the ground by means of the thrust unit; the rotary disengages the kelly bar and the winch lifts the kelly bar until the tool is extracted. The rotary tower can be actuated in order to rotate, moving the tool away from the hole drilled into the ground and the tool is actuated—for example, by the rotary that re-engages the kelly bar to rotate it—in order to release the soil collected during drilling.

Such a procedure is repeated until the desired depth of the hole is reached.

The Applicant discovered that the rotation of the winch caused by the lowering of the kelly bar under the effect of the weight force determines a transfer of mechanical (potential and kinetic) energy from the winch to the internal combustion motor through the hydraulic actuation system. In particular, the internal combustion motor acts as a brake for the descending travel of the kelly bar, reducing the descending speed and dissipating energy in the form of heat.

DE3721526 discloses a rotary drilling machine for the drilling of holes, wherein the drilling tool is fixed to a kelly bar by means of a rapid shift device provided with hydraulic connections.

EP2514706 discloses an energy recuperation device for converting the kinetic energy produced during the movement of a tool into electric power. The device has a generator that is mechanically coupled with a cable winch that supports a cable in such a way that the rotational energy produced by the cable is converted into electric energy by the generator.

DE102016116322 discloses a braking device for braking an electric cable winch of a construction machine suitable for regenerating energy during the braking.

BRIEF SUMMARY OF THE INVENTION

The purpose of the present invention is to disclose a self-propelled drilling machine for foundation piles capable of recovering the mechanical (potential/kinetic) energy associated with the rotation of the winch during the descending travel of the kelly bar in the hole drilled into the ground.

This and further purposes are achieved according to the invention with the characteristics of the independent claim 1.

Advantageous embodiments of the invention will appear from the dependent claims.

BRIEF DESCRIPTION OF THE SEVERAL VIEWS OF THE DRAWINGS

Additional features of the invention will appear clearer from the following detailed description, which refers to merely illustrative, not limiting embodiments, which are shown in the appended drawings, wherein.

DETAILED DESCRIPTION OF THE INVENTION

Figure 1:
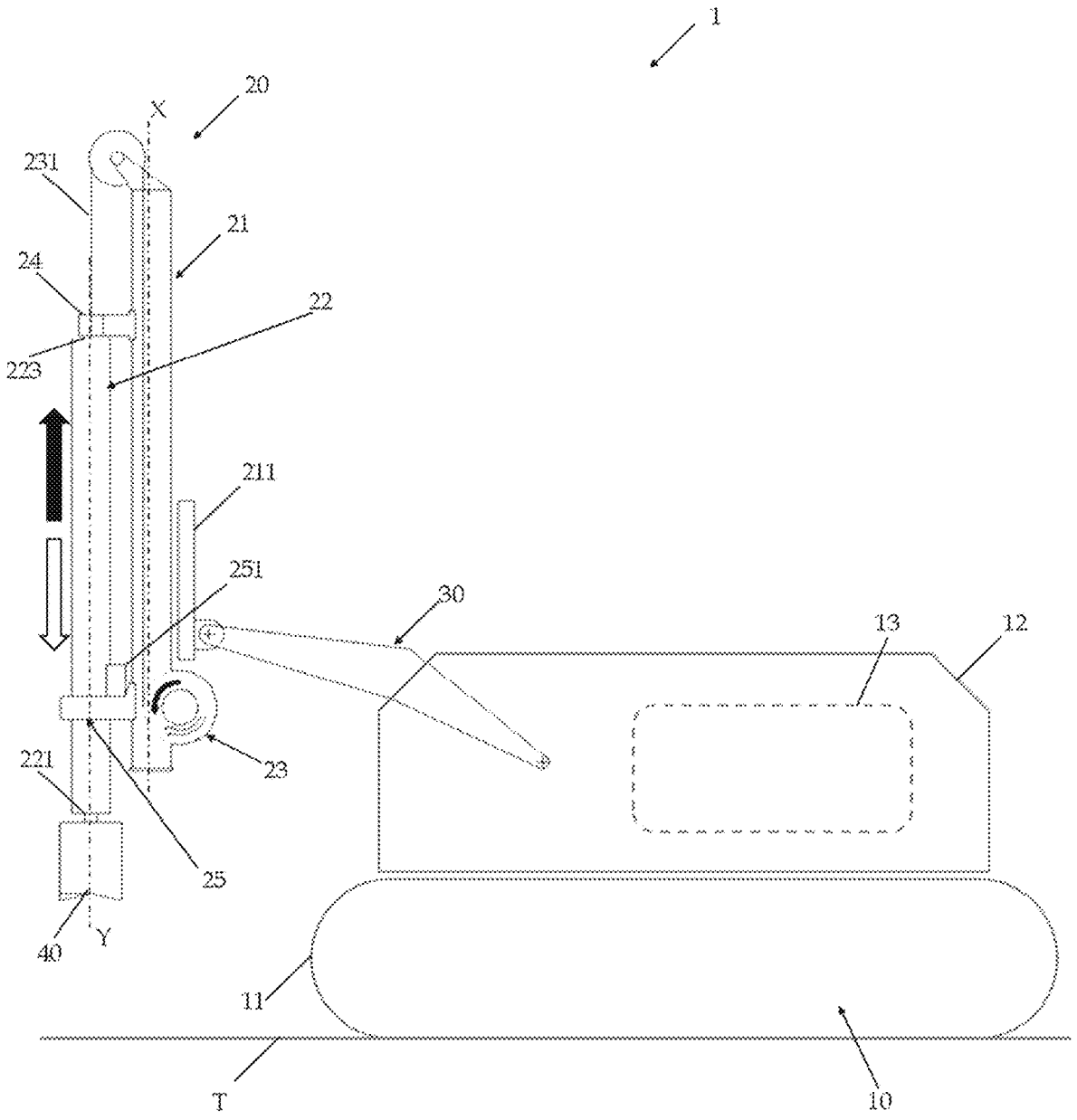
FIG. 1 is a diagrammatic side view of a drilling machine.

With reference to FIG. 1, the numeral reference (1) indicates a self-propelled drilling machine.

The machine (1) comprises an undercarriage (10) suitable for moving on the ground (T), a rotary tower (12) mounted on the undercarriage (10), a boom (30) coupled with the rotary tower (12) and a drilling assembly (20).

The undercarriage (10) comprises locomotion means, preferably tracks (11) actuated by an internal combustion motor (13) that is preferably housed in the rotary tower (12). The internal combustion motor (13) is operatively connected to the tracks (11), to the boom (30) and to the drilling assembly (20) for the transmission of driving force.

Additionally, the rotary tower (12) may comprise driving instruments (not shown), for example disposed in a driver's cab (not shown) and/or suitable for controlling the machine (1) from remote.

The boom (30) comprises a hydraulic actuation system (not shown), for example comprising one or more pistons or jacks that can be actuated to move the drilling assembly (20) relative to the undercarriage (10) and to the ground (T) to be drilled.

Advantageously, the boom (30) can house one or more operating connection elements, such as for example hydraulic ducts and/or electric cables (not shown), which permit a flow of fluid or electric current, respectively, between elements comprised in the rotary tower (12) and elements comprised in the drilling assembly (20) for the actuation of the drilling assembly.

The drilling assembly (20) comprises a mast (21) with elongated shape. In particular, the mast (21) has a major axis (X). The mast (21) is coupled with the boom (30).

The mast (21) is coupled with the boom (30) with possibility of sliding along a parallel direction to the major axis (X) of the mast (21). Advantageously, a thrust unit (211) connected to a hydraulic actuation system (not shown) allows for controlling the sliding movement of the mast (21) and accordingly the position of the mast (21) relative to the boom (30) and to the ground (T).

The mast (21) supports the other elements of the drilling assembly (20) hereinafter described.

The drilling assembly (20) comprises a normally telescopic kelly bar (22) with axis (Y). The kelly bar (22) comprises a first end (221) wherein a drilling tool (40) is fixed, and a second end (223) that acts as a constraint. Preferably, the kelly bar (22) has a cylindrical shape.

The kelly bar (22) is telescopic and comprises two or more pipes that are slidingly joined. An internal pipe comprises the first end (221), whereas an external pipe comprises the second end (223) that acts as a constraint.

In the example, the second end (223) of the kelly bar is fixed to one end of a cable or a chain (231) of a winch (23) mounted on the mast (21). The winch (23) can be mounted on the rotary tower (12).

Preferably, the second end (223) of the kelly bar (22) is also associated with a guide element (24), which is in turn associated with the mast (21). In view of the above, the kelly bar can slide in the guide element (24), in parallel direction to the major axis (X), in order to guide the movement of the kelly bar (22) during the operation of the machine (1).

The drilling assembly (20) also comprises a rotary (25) associated with the mast (21) and suitable for receiving the kelly bar (22). Consequently, the kelly bar (22) is slidingly coupled with the mast (21) in such a way to slide along a parallel direction relative to the major axis (X).

As it is known, the rotary (25) comprises a through hole suitable for slidingly receiving the kelly bar (22), and comprises moving elements suitable for rotating the kelly bar (22) around its axis (Y). The rotary (25) comprises a motor element (251) that rotates the kelly bar and consequently the tool mounted at the first end of the kelly bar.

The machine (1) comprises actuation means comprising an electric rotary machine (50) that is operatively connected to the winch (23) with drive means to transmit the rotation of the electric rotary machine (50) to the winch and vice versa. The term "electric rotary machine" refers to an electric machine provided with a rotor and a stator, which can operate as an electric motor to rotate the rotor or as an electric generator to generate electric power when the rotor is rotated.

In such a case, the rotor of the electric rotary machine (50) can be connected to the winch (23) with the drive means.

Figure 2A:
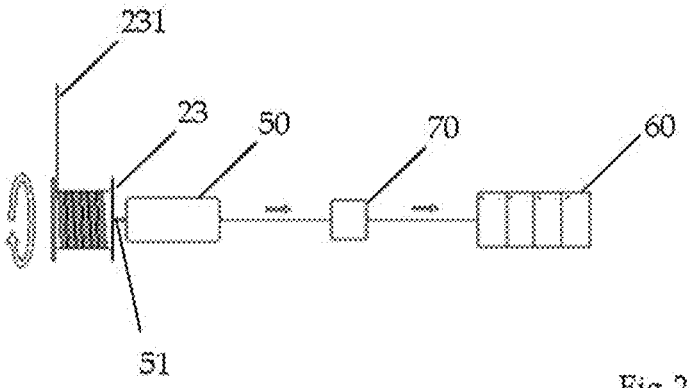
FIG. 2A is a diagrammatic view of an actuation assembly of the winch of the drilling machine of FIG. 1, during an energy recovery phase (descending travel of the kelly bar/tool assembly)
Figure 2B:
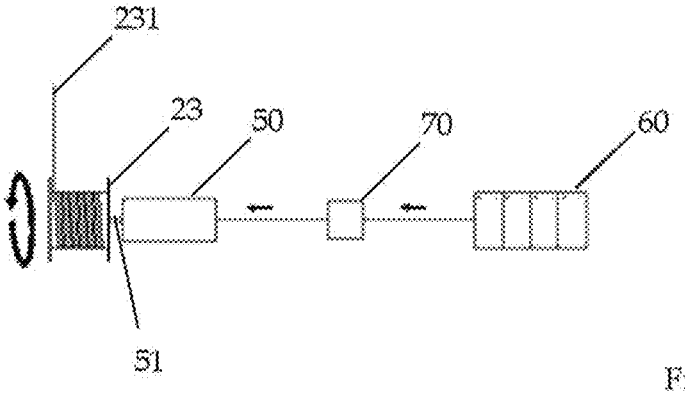
FIG. 2B is the same diagrammatic view as FIG. 2A, during an actuation step of the winch (lifting of the kelly bar/tool assembly)
Figure 3:
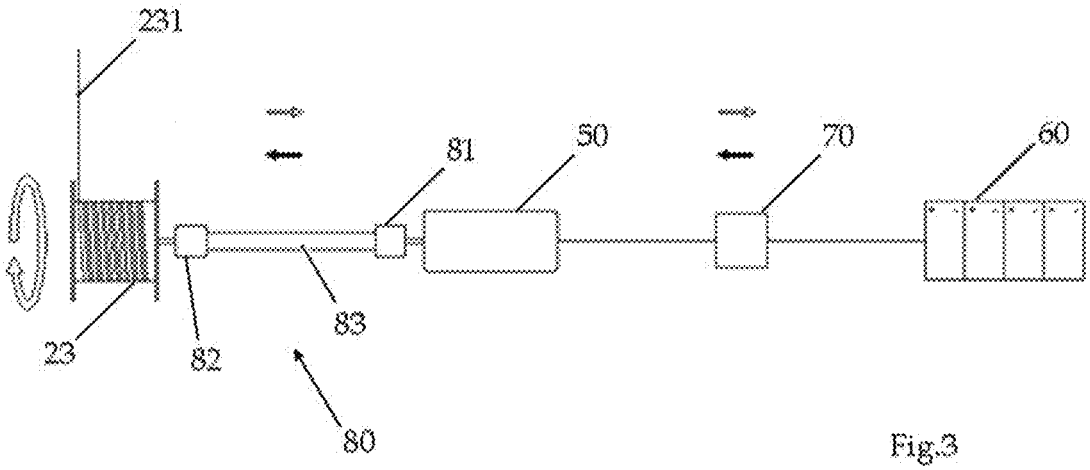
FIG. 3 is a diagrammatic view of an actuation assembly of a winch of a drilling machine according to an embodiment of the present invention.

Moreover, the machine (1) comprises a power supply unit (60) (shown in FIGS. 2A, 2B and 3). For example, the power supply unit (60) may comprise one or more batteries, capacitors or any other device suitable for storing the electric power.

The power supply unit (60) is connected to the electric rotary machine (50) to supply the electric power that is necessary to operate the electric rotary machine (50) as an electric motor for lifting the kelly bar provided with the drilling tool, or to store the electric power from the electric rotary machine (50) that operates as an electric generator during the lowering of the kelly bar provided with the drilling tool.

The connection between the power supply unit (60) and the electric rotary machine (50) is controlled by an electronic control unit (70) disposed in intermediate position.

FIG. 2A illustrates the electric rotary machine (50) directly coupled with the winch (23) by means of a mechanical transmission system (51).

During the operating steps of the machine (1), the mast (21) is disposed with the major axis (X) aligned in the direction desired for the hole to be drilled into the ground. For instance, the major axis (X) is parallel to the direction of the vector of the force of gravity. The winch (23) is actuated to let the tool (40) supported by the kelly bar (22) descend towards the ground (T), from a position wherein the tool is outside the hole, to a working position wherein the tool is in contact with the ground (T). The kelly bar (22) is rotated around its longitudinal axis (Y) by the rotary (25), whereas the thrust unit (211) lowers the mast (21) and/or the rotary to compress the tool (40) against the ground (T) in such a way to drill a hole.

In particular, the kelly bar (22) is moved closer to the ground (T) by the force of gravity, thus unwinding the cable (231) of the winch (23) and rotating the winch (23). Such a rotation of the winch (23) is transferred by the mechanical transmission means to the electric rotary machine (50) that is configured to operate as an electric generator, consequently producing electric power, and to simultaneously exert a braking force on the rotation of the winch (23) in order to limit the descending speed of the kelly bar provided with the drilling tool.

Consequently, the electric rotary machine (50) converts the potential kinetic energy associated with the descending travel towards the ground (T) of the kelly bar provided with the tool into electric power than can be transferred and stored in the power supply unit (60) for later use. Moreover, the engine brake effect caused by the operation of the electric rotary machine (50) as a generator limits the descending speed of the kelly bar (22), thus guaranteeing a safe operation that can be easily controlled by the electronic control unit (70) of the drilling assembly (20).

When a first drilling depth is reached, the tool (40) is extracted from the hole to remove the excavated soil. During this step, the thrust unit (211) lifts the mast (21) and/or the rotary (25). The rotary (25) interrupts the rotation and disengages the kelly bar (22).

As shown in FIG. 2B, the winch (23) is rotated by the electric rotary machine (50) that operates as an electric motor in order to lift the kelly bar (22) and move the tool (40) away from the ground (T), for instance to bring the kelly bar (22) back to its idle position, as illustrated in FIG. 1. Finally, the rotary tower (12) of the machine (1) is rotated to move the drilling assembly away from the hole and the tool (40) is moved—for example by the rotary (25) that engages and re-rotates the kelly bar (22)—to release the excavated soil.

In particular, the electric rotary machine (50) operates as a motor that absorbs the electric power stored by the power supply unit (60) and transfers the rotation on the winch (23) that rewinds the cable (231), lifting the kelly bar provided with the tool in such a way to move the tool away from the ground (T).

The Applicant noted that the use of the electric rotary machine (50) as electric motor to actuate the winch (23) permits the uniform, accurate lifting of the kelly bar (22). Moreover, the Applicant noted that the use of the electric rotary machine (50) as an electric motor permits to achieve a higher speed during the lifting of the kelly bar (22) compared to the speed that is obtained with an internal combustion motor according to the prior art. As a matter of fact, the operation of the electric rotary machine (50) as an electric motor permits to achieve an instantaneous power that is higher than the power of an internal combustion motor.

FIG. 3 illustrates an embodiment of the invention, wherein the drive means may comprise a hydraulic actuation system (80) to transmit the rotation from the electric rotary machine (50) to the winch (23) and vice versa.

The hydraulic actuation system (80) comprises:

- a first hydraulic rotating machine (81) connected to the electric rotary machine (50);
- a second hydraulic rotating machine (82) connected to the winch (23); and
- a conduit (83) that connects the first hydraulic rotating machine (81) to the second rotating hydraulic machine (82).

The two hydraulic rotating machines (81, 82) can operate as a pump and as a hydraulic motor.

When the electric rotary machine (50) operates as an electric motor, the first hydraulic rotating machine (81) operates as a pump to pump fluid towards the second hydraulic rotating machine and the second hydraulic rotating machine (82) operates as a hydraulic motor to rotate the winch (23).

On the contrary, during the descending travel of the kelly bar provided with the tool (40), the winch (23) rotates, thus making the second hydraulic rotating machine (82) operate as a pump in order to pump fluid towards the first hydraulic rotating machine (81) that operates as a hydraulic motor, causing the rotation of the electric rotary machine (50) that operates as an electric generator.

Figure 4:
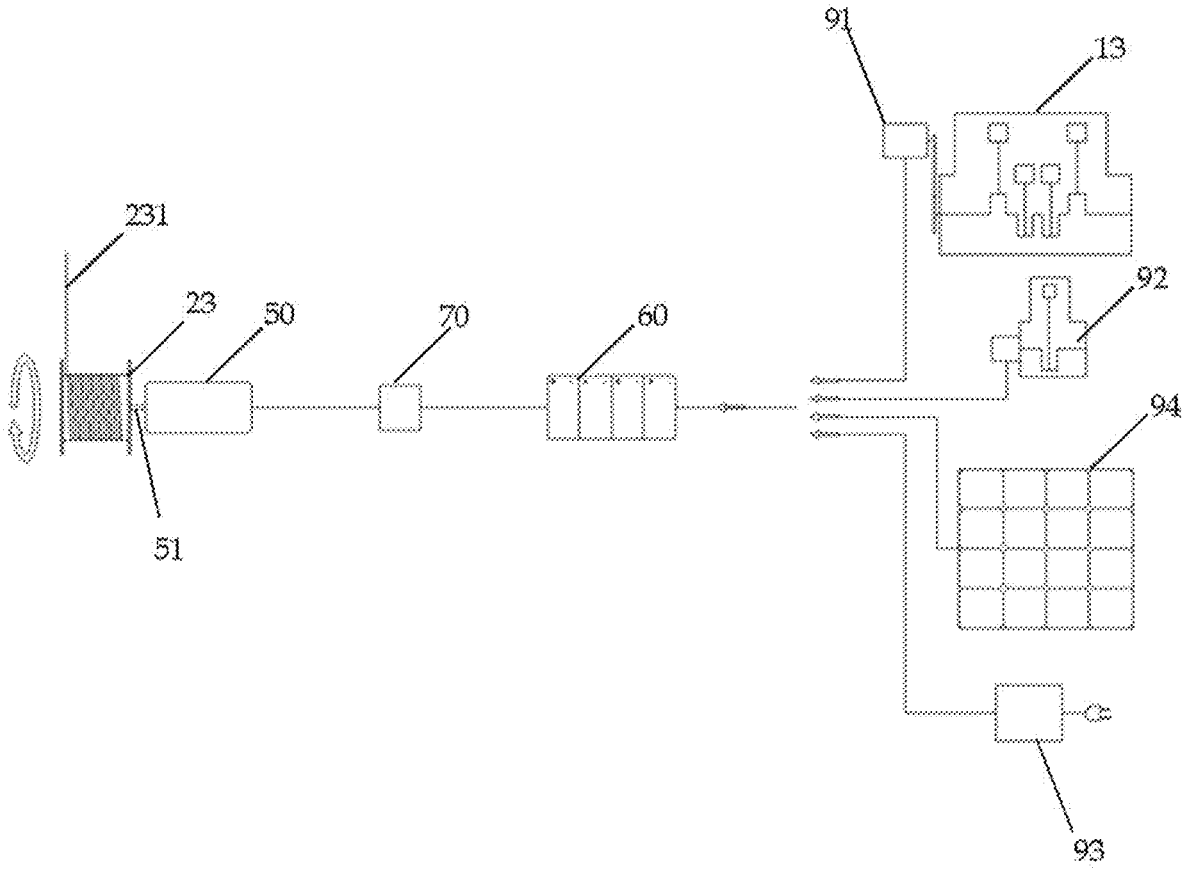
FIG. 4 is a diagrammatic view of electricity sources that can be associated with a power unit of a drilling machine according to the invention.

With reference to FIG. 4, the power supply unit (60) can be operatively connected to one or more sources of electric power to restore the level of power in the power supply unit (60). In fact, because of <1 efficiency, the energy that is consumed during the lifting of the kelly bar provided with the tool is higher than the energy that is recovered during the descending travel.

The energy can be restored in the power supply unit (60) in several alternative or variously associated ways. The machine may comprise one or more of the following components:

- an electric generator (91) associated with the internal combustion motor (13) of the machine (1), which is suitable for converting the mechanical energy produced by the internal combustion motor (13) into electric power;
- a connector used for connection to a generating set (92);
- a mains power supply (93) used for taking energy from the mains;
- an electricity generator composed of multiple photovoltaic panels (94) that are sensitive to sunlight.

The power supply unit (60) and the electronic control unit (70) can be integrated in the rotary tower (12) or in the undercarriage (10). The electronic control unit (70) can be integrated in a CPU of the machine (1).

Numerous equivalent variations and modifications can be made to the present embodiment of the invention, which are within the reach of an expert of the field, and fall in any case within the scope of the invention as disclosed by the appended claims.

I claim:

1. Self-propelled drilling machine for drilling holes for piles, said machine comprising:

- an undercarriage suitable for moving on the ground;
- a rotary tower revolvingly mounted on the undercarriage;
- a mast connected to the rotary tower;
- a kelly bar slidingly supported by the mast;
- a rotary supported by the mast and suitable for coupling with the kelly bar to drive the kelly bar into rotation;
- a drilling tool fixed to one first end of the kelly bar;
- a winch associated with the kelly bar to move the kelly bar upwards or downwards;
- moving means connected to the winch to rotate the winch, said moving means comprising an electric rotary machine connected to the winch, said electric rotary machine being configured to operate as an electric motor suitable for rotating the winch to lift the kelly bar, and as an electric generator during the lowering of the kelly bar that causes a rotation of the winch;
- a power supply unit operatively connected to said electric rotary machine, said power supply unit being configured to supply electric power to the electric rotary machine that operates as an electric motor during the lifting of the kelly bar and to store the electric power generated by the electric rotary machine that operates as an electric generator during the lowering of the kelly bar;
- drive means disposed between the electric rotary machine and the winch to transmit a rotational motion from the electric rotary machine to the winch and vice versa;
- said drive means comprising a hydraulic actuation system comprising:
  - a first hydraulic rotating machine connected to the electric rotary machine;
  - a second hydraulic rotating machine connected to the winch; and
  - a conduit that connects the first hydraulic rotating machine to the second rotating hydraulic machine;
  - wherein the two hydraulic rotating machines (81, 82) can operate as a pump and as a hydraulic motor.

2. The machine of claim 1, wherein:

the first hydraulic rotating machine is configured to operate as a pump to pump fluid towards the second hydraulic rotating machine, and the second hydraulic rotating machine is configured to operate as a hydraulic motor to rotate the winch when the electric rotary machine operates as an electric motor;

the second hydraulic rotating machine is configured to operate as a pump to pump fluid towards the first hydraulic rotating machine that operates as a hydraulic motor that rotates the electric rotary machine that operates as an electric generator during the descending travel of the kelly bar provided with the tool that rotates the winch.

3. The machine of claim 1, wherein the power supply unit can be operatively connected in order to receive electric power to at least one from:

an electricity generator associated with an internal combustion motor of the machine;

a generating set;

a mains power supply that can be coupled to the mains;

an electricity generator comprising photovoltaic panels.

* * * * *